US005862564A

United States Patent [19]

Hamm

[11] Patent Number: 5,862,564

[45] Date of Patent: Jan. 26, 1999

[54] PERSONAL SANITARY INSTRUMENT

[76] Inventor: Natascha B. Hamm, 897 Glide Loop Rd., Glide, Oreg. 97443

[21] Appl. No.: 753,515

[22] Filed: Nov. 26, 1996

[51] Int. Cl.[6] ..... A47K 7/08

[52] U.S. Cl. ..... 15/210.1; 15/143.1; 15/144.1; 15/144.3; 601/137; 604/1; D24/124; D24/133; D24/214

[58] Field of Search ..... 15/143.1, 144.1, 15/144.3, 209.1, 210.1; 601/135, 137; 604/1; D24/119, 124, 133, 141, 200, 211, 214, 215

[56] References Cited

U.S. PATENT DOCUMENTS

| | | | |
|---|---|---|---|
| 2,315,054 | 3/1943 | Heber | 15/210.1 |
| 2,477,666 | 8/1949 | Smallen | 601/135 |
| 2,635,274 | 4/1953 | Hatcher et al. | 15/210.1 X |
| 2,744,279 | 5/1956 | Heber | 15/201.1 |
| 3,332,103 | 7/1967 | Case | 15/210.1 X |
| 3,568,237 | 3/1971 | Rhodes | 15/244.2 |
| 3,935,611 | 2/1976 | Locher | 15/160 |
| 4,002,164 | 1/1977 | Bradley | 601/135 |
| 4,060,047 | 11/1977 | Sabella | 114/222 |
| 4,117,566 | 10/1978 | Ward | 15/210.1 X |
| 4,813,094 | 3/1989 | Krotine | 15/244.1 |
| 5,044,040 | 9/1991 | Tetrault | 15/210.1 |
| 5,560,746 | 10/1996 | Willow | D24/214 X |

FOREIGN PATENT DOCUMENTS

| | | | |
|---|---|---|---|
| 712391 | 10/1931 | France | 15/143.1 |
| 292523 | 12/1935 | Italy | 15/143.1 |
| 335822 | 3/1959 | Switzerland | 15/143.1 |
| 651454 | 4/1951 | United Kingdom | 15/210.1 |

*Primary Examiner*—Mark Spisich

*Attorney, Agent, or Firm*—Anderson & Adamson; C. Douglas DeFreytas

[57] ABSTRACT

A personal sanitary device is provided to assist individuals in personal hygiene, and specifically to provide a device for overweight or otherwise activity-limited individuals to wipe and to cleanse their excretory orifices, and surrounding areas. The device includes laterally extending handle sections for grasping and manipulation by a user. The handle is attached to one end of a rod. The other end of the rod is connected to a finger member which may be fitted with a disposable cover when used. The device is formed in sections that may be separated for storage.

8 Claims, 3 Drawing Sheets

PERSONAL SANITARY INSTRUMENT

BACKGROUND OF THE INVENTION

1. Field of the Invention

This invention relates to personal hygiene devices. More particularly it relates to a device to assist a user in the cleansing of excretory orifice areas after elimination functions.

2. Related Art

Individuals who suffer from obesity or certain physical disabilities may find it difficult or impossible to reach their excretory orifices after excretion and are therefore unable to perform personal cleansing without assistance from other individuals or mechanical devices. Assistance from other individuals is not always available and is undesirable due to personal embarrassment or the lack of suitable personnel. A mechanical device is needed that is simple to use without assistance, inexpensive, and portable.

Several devices have been developed for such personal cleansing. One such device, as disclosed in U.S. Pat. No. 5,067,194, issued to Rosenfeld, et al. On Nov. 26, 1991, discloses a device with a wiper member attached to a handle rotationally offset from the wiper member. Another device disclosed in U.S. Pat. No. 5,044,040, issued to Tetrault on Sep. 3, 1991, is similar to the Rosenfeld device in that it has a handle offset from the base at an obtuse angle. U.S. Pat. No. 3,935,611, issued to Locher on Feb. 3, 1976, discloses a curved brush with several variations and a unitary handle piece. None of these devices affords the user a handle which may be easily grasped with both hands simultaneously.

SUMMARY OF THE INVENTION

The present invention overcomes the deficiency of the existing art by providing bilateral control which accommodates central operation of the personal sanitation instrument. Observing that excretory orifices are mesial, it is desirable that a device for cleansing such orifices should be bilaterally operable to provide optimal use of both upper extremities. The advantage of such bilateral control may be envisioned in the same way that control of a bicycle is enhanced when both hands are controlling the handle bars.

Accordingly, a device made in accordance the present invention is preferably used by directing a finger member of the device between the user's legs from the front, affording central manipulation of the finger member on and around the orifice being cleansed. In addition, any of several commercially available paper or cloth products may be adapted to cover the finger member of the present invention such that the finger member remains clean; the covering product may then be disposed of after use.

These and other advantages and features of the present invention will be apparent from the preferred embodiment described in the following detailed description and in the accompanying drawings.

DETAILED DESCRIPTION OF THE PREFERRED EMBODIMENT

Figure 1:
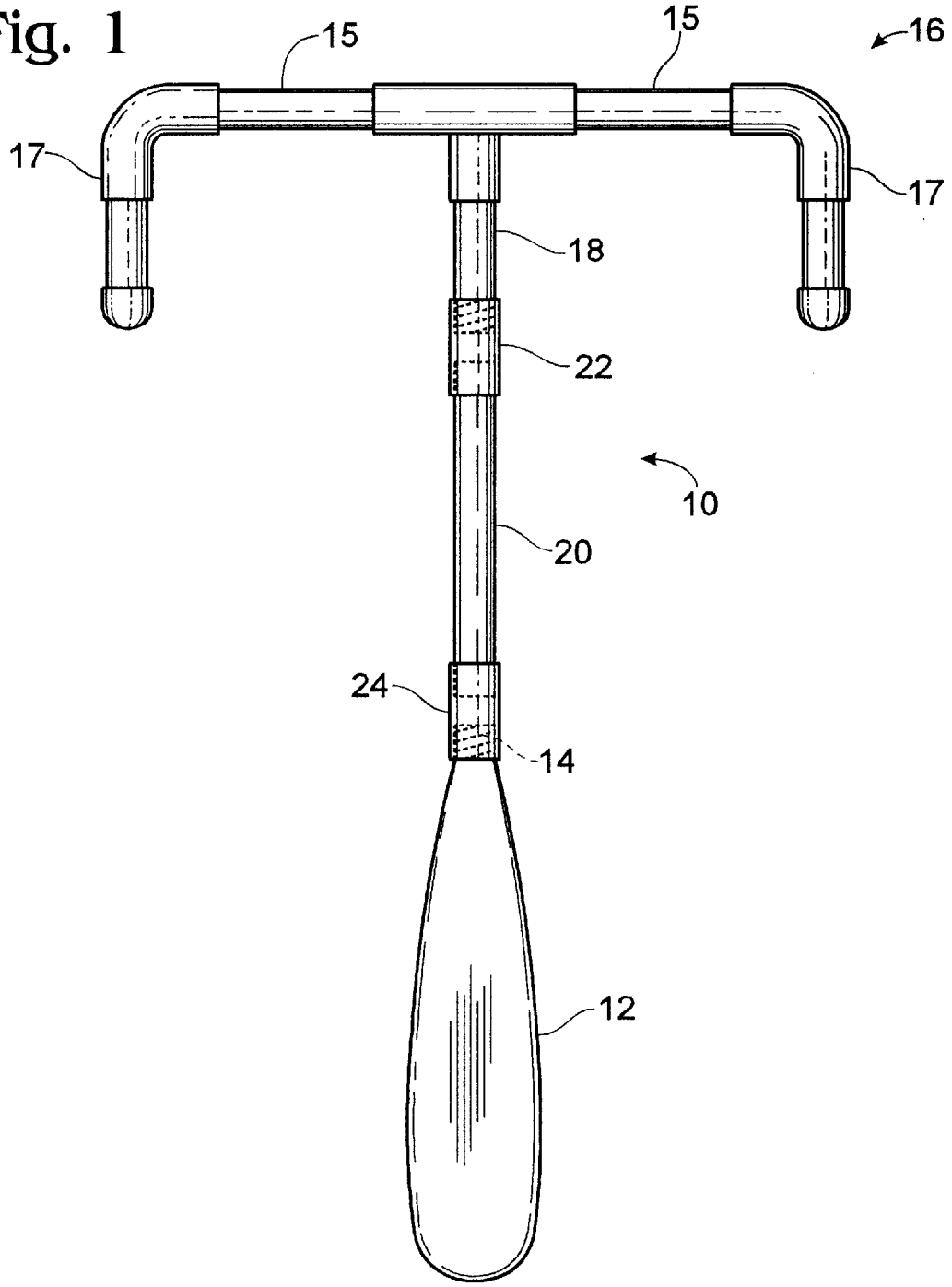
FIG. 1 is a plan view of a first preferred embodiment of a sanitary device made according to the invention.
Figure 2:
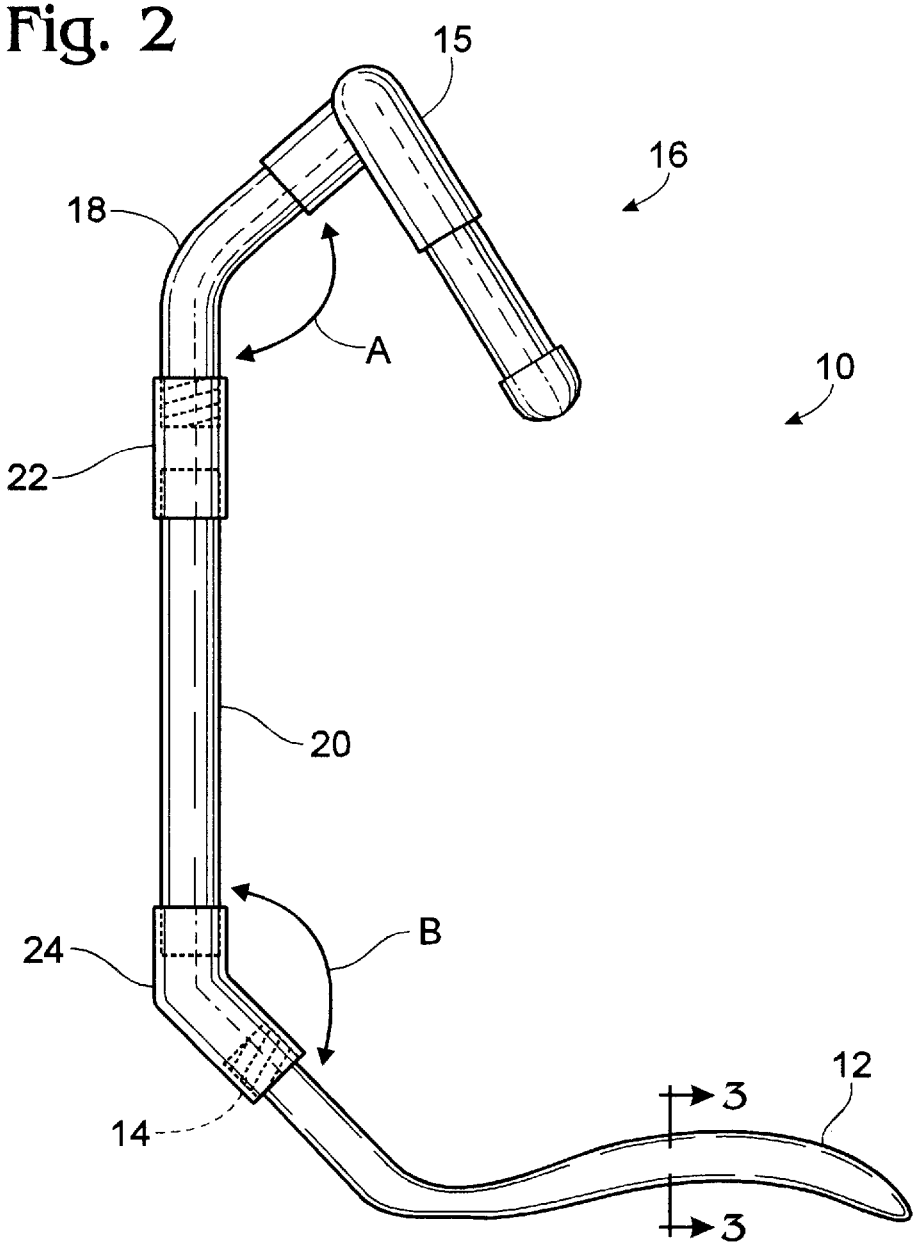
FIG. 2 is a side view of the device of FIG. 1.
Figure 3:
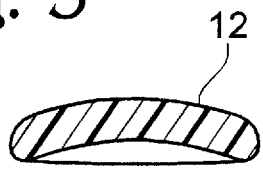
FIG. 3 is a cross-sectional view taken generally along the line 3—3 of FIG. 2.

Referring to the drawings, a device constructed in accordance with the present invention is shown generally at 10 in FIG. 1. In FIG. 2 a side view of the device is shown illustrating all offset handle 16 and finger member 12, each forming obtuse angles A and B, respectively, with a rod 20. Also seen in FIG. 2 is the general S-shape of finger member 12. FIG. 3 depicts a cross-sectional view of finger member 12 taken along the line 3—3 in FIG. 2, illustrating curvature of finger member 12 and its flattened distal end. Handle 16 includes a crossbar 15 seen orthogonally connected through an elbows member 18 to rod 20 forming a general T-shape as depicted in FIG. 1. Offset phalanges 17 are should connected at the distal ends of crossbar 15. Rod 20 is attached to a sleeve 22 which has a threaded opening for attachment of elbow member 18. The opposite end of rod 20 is similarly attached to an offset sleeve 24 which has a threaded opening for attachment of a threaded connection 14 on finger member 12.

Device 10, for simplicity of construction, is formed of commercially available one-half-inch polyvinyl chloride pipe conventionally used for plumbing and lightweight framing. Angles in the device are shown made with conventional elbows. They may also be made by heating and bending the pipe using conventional techniques. The finger member is custom formed as shown out of plastic using commercially known techniques. Other materials may also be used. Threaded joints between sections allows for disassembly.

Figure 4:
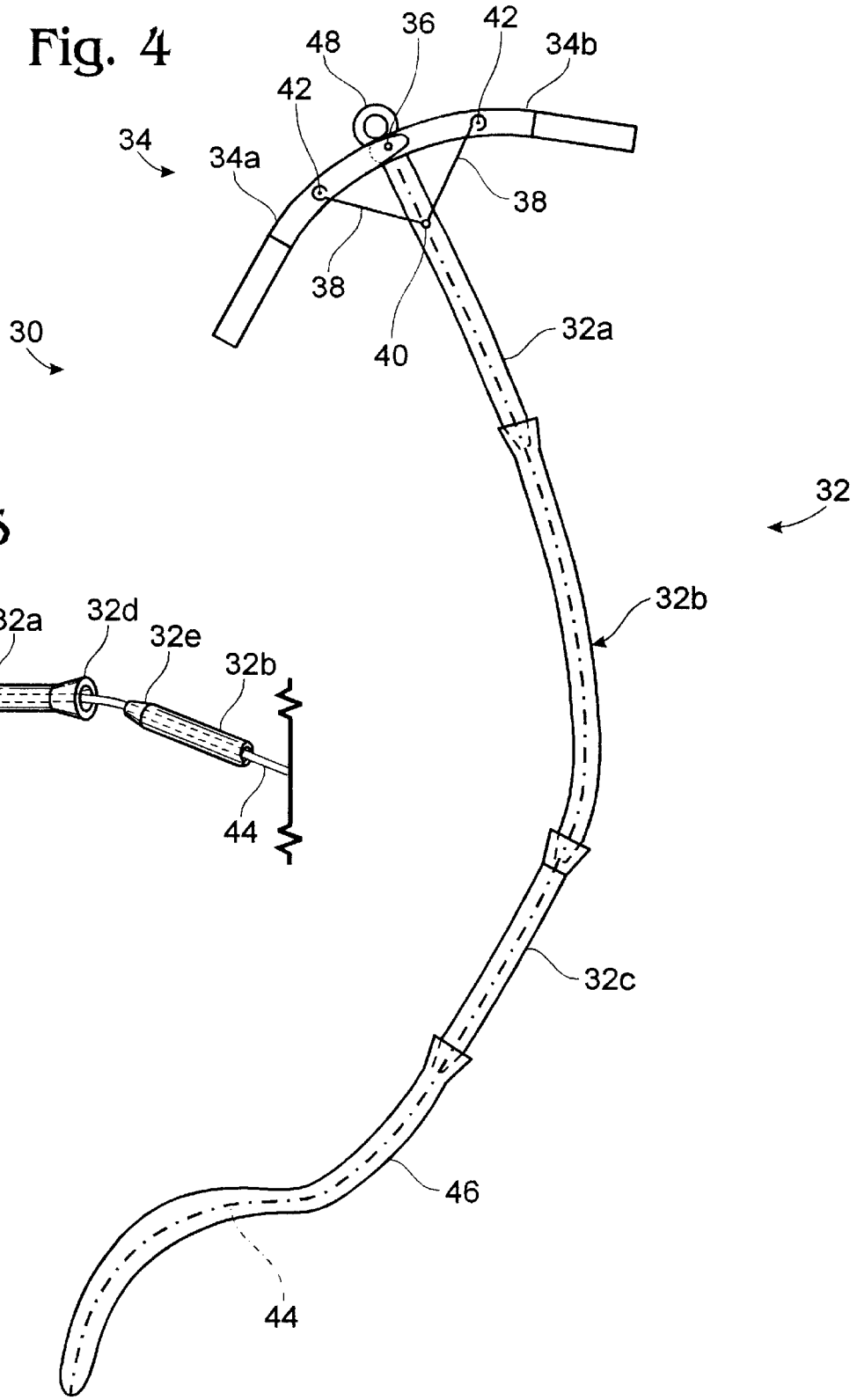
FIG. 4 is a perspective view of another embodiment of a device made according to the invention showing the handle rotated ninety degrees from normal operative position for purposes of illustration.

FIG. 4 shows another embodiment, a device 30, also constructed in accordance with the present invention. In this embodiment, a main rod 32 comprises three sections, 32*a*, 32*b*, and 32*c*. A handle 34 comprises two sections 34*a* and 34*b*. The two sections are pivotally connected to one end of rod section 32*a* with pin 36. This embodiment also includes struts 38 each pivotally connected to rod section 32*a* by a pin 40, and each has a hook at its free end for detachable connection to pins 42 on handle 34 when the handle is extended in operating position, as shown.

This embodiment further includes a resilient, flexible cord 44 traversing through rod 32, and fixedly attached internally to a finger member 46 and rod section 32*a*. Flexible cord 44 provides tension to urge rod sections 32*a*, 32*b*, and 32*c*, and finger member 46 to seat with their adjacent counterparts. The tension of cord 44 is determined by the relaxed-state length of the cord used. Finger member 46 is shaped the same as finger member 12. The handle, rod and finger member may be made of plastic, aluminum, or other suitable material using conventional techniques.

Figure 5:
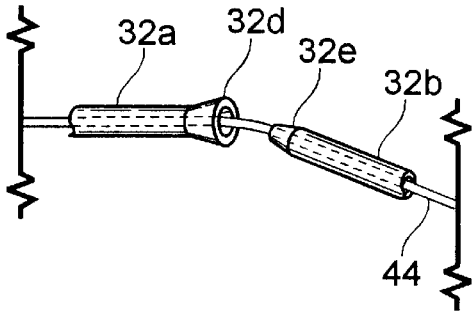
FIG. 5 is a detail view of a typical rod-to-rod connection of the device of FIG. 4.

FIG. 5 shows the transition between two sections of device 30 such as rod sections 32*a* and 32*b*, and the flexible cord 44. Transitions between rod sections 32*b* and 32*c*, and between rod section 32*c* and finger member 46 are identical to the detail shown in FIG. 5. In order to prevent the sections of device 30 from rotating relative to each other, respective ends that fit together should be shaped to prevent rotation, such as by eccentric points 32*c* and 32*e*, by keys and keyways, or the like. Device 30 also includes a hook ring 48 for hanging the device when not in use.

Describing operation of the first embodiment of the present invention as depicted in FIGS. 1 through 3, device 10 is assembled by the user by attaching handle 16 to rod 20, by screwing threaded elbow 18 into sleeve 22, and by screwing finger threaded connection 14 into offset sleeve 24. Handle 16 forms a shape similar to a bicycle handlebar. Phalanges 17 are grasped by both of the user's hands and manipulated such that finger member 12 is guided between the user's legs to the orifice to be cleansed. Through a combination of axial and rotational motions, finger member 12 wipes the target orifice. Before using, any commercially available cloth or paper product may be attached to, or wrapped around the finger member 12 to provide a disposable cleansing medium. One such product is New Freedom® pantiliners sold by Kimberly-Clark Corporation of Neenah, Wis. Also, the user may wrap ordinary toilet tissue around the finger member before use and discard the soiled tissue after use.

Operation of the second embodiment of the present invention as depicted in FIGS. 4 and 5 is accomplished by first assembling the device by seating rod section 32*c* into finger member 46, rod section 32*b* into rod section 32*c*, and rod section 32*a* into rod section 32*b*. Handle 34 is then extended and Struts 38 attached to the handle. The device is now fully assembled and operation is the same as described for the first embodiment.

Variations in form and detail of the first and second embodiments may be made without departing from the scope of the described invention as literally set forth in the claims and as provided under the doctrine of equivalents. For example, the number of rod sections could vary. The first embodiment could include a hook ring 48 as depicted on the second embodiment. Either embodiment could be of unitary construction, made of various materials, or have different ways of joining separable sections together.

I claim:

1. A personal sanitary instrument comprising:

an elongate handle;

an elongate finger member; and a rod having a first end generally orthogonally attached near to the center of the handle, forming a general T-shape with the handle, and a second end attached to the finger member;

the handle further comprising two sections pivotally attached to the rod.

2. A personal sanitary instrument comprising:

an elongate handle;

an elongate generally S-shaped finger member having a curved proximal end and a flattened distal end; and a rod having a first end generally orthogonally attached near to the center of the handle, forming a general T-shape with the handle, and a second end fixedly attached to the proximal end of the finger member.

3. A personal sanitary instrument comprising:

an elongate handle;

an elongate finger member; and a rod having a first end generally orthogonally attached near to the center of the handle and offset at an obtuse angle relative to the handle, forming a general T-shape with the handle, and a second end attached to the finger member and offset at an obtuse angle relative to the finger member generally in the same direction as the first end.

4. The sanitary instrument of claim, 3 wherein the handle, rod and finger member are constructed of a thermoplastic resin.

5. The sanitary instrument of claim 4 in which the handle is threadedly disconnectable from the rod.

6. The sanitary instrument of claim 5 in which the finger member is threadedly disconnectable from the rod.

7. A personal sanitary instrument comprising:

a tubular rod having a first end threadedly attached to a sleeve and a second end;

a tubular elbow member having a first end attached to the first end of the rod and a second end extending obtusely relative to the rod;

a tubular handlebar member, generally, shaped like a bicycle handlebar and attached to the second end of the elbow member; and a finger member forming a general S-shape, having a proximal end attached to the second end of the rod, extending outwardly from the rod at an obtuse angle generally in the same plane as the elbow member, and having a distal end flattened in a plane perpendicular to the plane of the elbow member.

8. A personal sanitary instrument comprising:

a plurality of hollow rods each having one flanged end and one tapered end, matingly connected flanged end to tapered end and forming a rod assembly having an arcuate shape;

a handle comprising two sections pivotally connected at a first end of the rod assembly and forming a general T-shape with the rod assembly, each section of the handle further having a strut detachedly connected front each handle section to an adjacent point on the rod assembly;

a finger member having a proximal end attached to a second end of the rod assembly, the finger member formed into an S-shape and having a flattened distal end; and a flexible, resilient cord extending through the plurality of rods and having ends fixedly connected to respective first and second ends of the rod assembly.

* * * * *